US008127392B2

(12) United States Patent
Wilson

(10) Patent No.: US 8,127,392 B2
(45) Date of Patent: Mar. 6, 2012

(54) CONVERTIBLE BROOM

(76) Inventor: Richard Wilson, West Bloomfield, MI (US)

( * ) Notice: Subject to any disclaimer, the term of this patent is extended or adjusted under 35 U.S.C. 154(b) by 722 days.

(21) Appl. No.: 12/251,740

(22) Filed: Oct. 15, 2008

(65) Prior Publication Data

US 2009/0094769 A1 Apr. 16, 2009

Related U.S. Application Data

(60) Provisional application No. 60/998,702, filed on Oct. 15, 2007.

(51) Int. Cl.
*A46B 5/00* (2006.01)
*A46B 15/00* (2006.01)

(52) U.S. Cl. ..... 15/144.1; 15/172

(58) Field of Classification Search ..... 15/144.1, 15/172

See application file for complete search history.

(56) References Cited

U.S. PATENT DOCUMENTS

| | | | | |
|---|---|---|---|---|
| 1,186,915 | A | 6/1916 | Landis | |
| 1,362,811 | A * | 12/1920 | Mills | 15/146 |
| 2,032,664 | A | 3/1936 | Raptis | |
| 2,689,967 | A | 2/1952 | Mackey | |
| 3,795,933 | A * | 3/1974 | Seufert | 15/114 |
| RE33,431 | E | 11/1990 | Sartori | |
| 5,339,840 | A * | 8/1994 | Koppel | 132/151 |
| 5,414,889 | A | 5/1995 | Sartori | |
| 6,931,690 | B2 * | 8/2005 | Cox | 15/245 |

* cited by examiner

*Primary Examiner* — Randall Chin
(74) *Attorney, Agent, or Firm* — John R. Benefiel

(57) ABSTRACT

A convertible broom having a broom head able to be selectively latched in either of two pivoted angular positions with respect to a broom handle. A latch mechanism includes a sleeve grip slidable on the handle to move a locking feature into and out of engagement with either of two locator features or pairs of locator features on a head bracket pivotally mounted to one end of the handle. On locator feature (or pair of features) is aligned with the locking feature with the broom head in a straight configuration, the other locator feature aligned with the locking feature with the broom head in a push broom configuration.

9 Claims, 6 Drawing Sheets

CONVERTIBLE BROOM

CROSS REFERENCE TO RELATED APPLICATIONS

This application claims the benefit of U.S. provisional patent application Ser. No. 60/998,702 filed on Oct. 15, 2007.

BACKGROUND OF THE INVENTION

This invention concerns brooms and more particularly brooms having a broom head which is adjustable angularly with respect to the broom handle.

Such brooms have been proposed in the past to increase the usefulness of a straight broom, allowing its use as a push broom, or vice versa. Oftentimes, when sweeping It would be desirable to switch between a push and straight broom configurations. This would require a quick change mechanism in order to be practical.

However, the angle adjustment mechanisms heretofore proposed have been inconvenient to operate or too time consuming to operate, introduce excessive looseness in the connection between the handle and the broom head, and/or are relatively complex.

It is the object of the present invention to provide a broom with a simple broom head angular adjustment which allows quick and convenient adjustments of the angle of the broom head with respect to the handle while maintaining a rigid connection between the broom head and the handle.

SUMMARY OF THE INVENTION

The above recited object as well as other objects which will be understood upon a reading of the following specification and claims are achieved by a pivot latch mechanism manually operated by an operator member from a point intermediate the length of the handle.

The pivot latch mechanism features engagement of a plurality of locator features fixed relative the broom head with a locking element spring loaded to engage one of the locator features and moved out of engagement by movement of the operator member.

The broom head is pivotally attached to the handle with a bracket so that when released and the broom is held correctly, the broom head will pivot by gravity from one position to another whereat it is again locked in position upon release of the operator member and re-engagement of the locking element.

In the preferred embodiment, the locator features comprise two sets of pockets or recesses formed into each side of a pivot bracket attached to the broom head, and the locking element comprises a cross pin spring loaded to engage one of two the sets of recesses.

The operator member preferably comprises a sleeve grip slidable on the handle connected to one end of an inner elongated member which holds the cross pin on an inner end.

Pulling up on the sleeve grip against a spring bias disengages the cross pin from the set of recesses in which it was disposed allowing the broom head to pivot to the other position whereat the cross pin will engage the other set of recesses to again lock the broom head to the handle in the other angular position.

DETAILED DESCRIPTION

Figure 1:
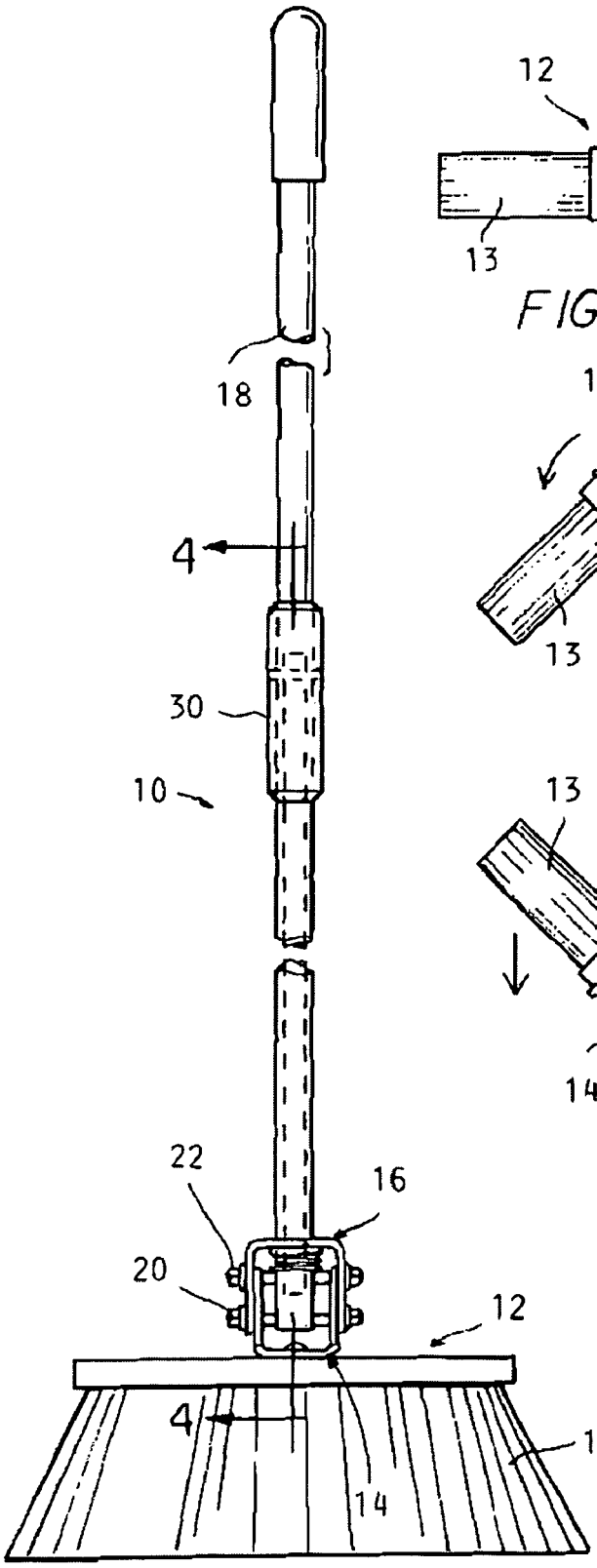
FIG. 1 is a front elevational view of a first embodiment of a convertible broom according to the present invention.

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Referring to FIGS. 1-4B, a convertible broom 10 according to one embodiment of the invention is shown which includes a broom head 12 having bristles 13 projecting therefrom which is mounted to a U-shaped head bracket 14 received in an oppositely directed U-shaped handle bracket 16 secured to one end of an elongated broom handle 18. A fixed pivot element comprised of a pivot cross bolt 20 allows pivoting of the broom head 12 when a locking feature comprised of a movable locking element or cross bolt 22 is retracted out of either of two sets of aligned locator notches or recesses 24A-1, 24B-1, 24A-2, 24B-2 in respective side walls 26A, 26B (FIGS. 4A, 4B) of the head bracket 14.

The locking cross bolt 22 passes through an actuator tube 28 slidable in the handle 18 to be drivingly connected to a sleeve grip 30 slidable on the handle 18 at about its midpoint via a connector pin 32 in the sleeve grip passing through aligned upper slots 34B in the handle 18 to allow a limited sliding motion of the sleeve grip 30 on the handle 18. Slots 36A, 36B in the side walls 38A, 38B of handle bracket 16 accommodate movement of the locking cross bolt 22 with the actuator tube 28. The combination of the sleeve grip 30 and tube 28 comprise an operator for the pivot latch mechanism comprised of the locking cross bolt 22 and head bracket 14.

A spring 40 acts on the movable locking cross bolt 22 to urge it to its locking position (shown in FIG. 3A) in which spring 40 is compressed when the sleeve grip 30 is pulled up to release the locking cross bolt 22 and the head bracket 14. Lower slots 34A in the handle 18 accommodate up and down movement of the cross bolt 22.

Figure 2A:
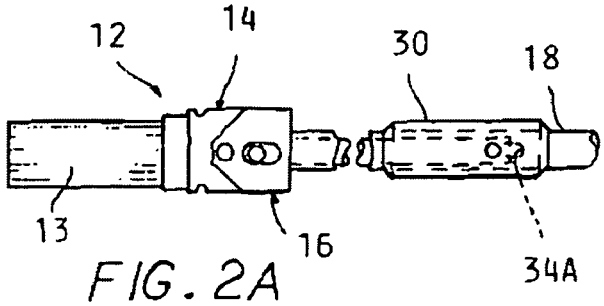
FIG. 2A is a fragmentary view of the broom shown in FIG. 1 held in a horizontal position with the broom head locked in the straight broom configuration.
Figure 2B:
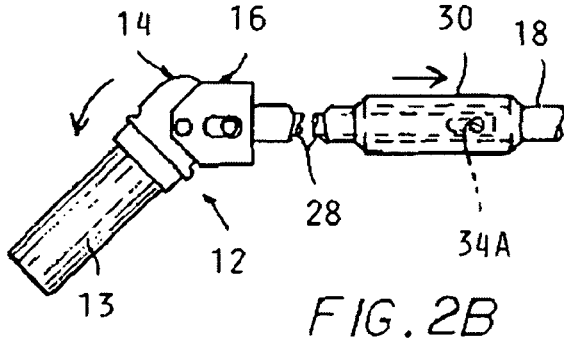
FIG. 2B is a view of a broom as shown in FIG. 2A but with the broom head released and dropped down to the push broom configuration.

When making an adjustment, the broom 10 is held generally horizontally as seen in FIG. 2A and the sleeve grip 30 thereafter retracted as seen in FIG. 2B to cause the broom head 12 in the straight broom orientation to be released by retraction of the movable cross bolt 22 out of notches 24A-1, 24A-2 and thereafter pivot down by gravity to the push broom configuration as shown in FIG. 2B. Projecting ledges 25B-1, 25B-2 of the notches 24B-1, 24B-2 catch the locking cross bolt 22 and guides the ends of the locking bolt 22 into notches 24B-1, 24B-2 when the sleeve grip 30 is released and spring 40 pushes the elongated tube 28 and cross bolt 22 back down, locking the broom head 12 in the push broom configuration.

Figure 2C:
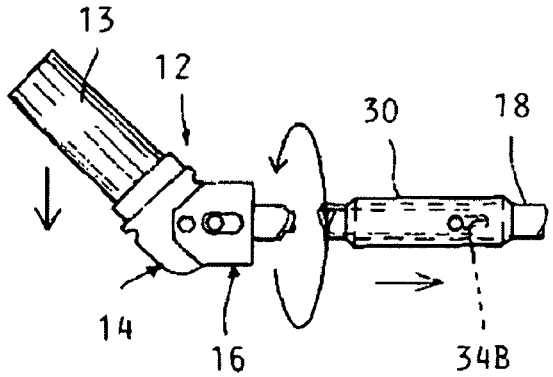
FIG. 2C is a view of a broom as shown in FIG. 2B but rotated and the broom head released but having not yet dropped back down to the straight broom configuration.
Figure 3A:
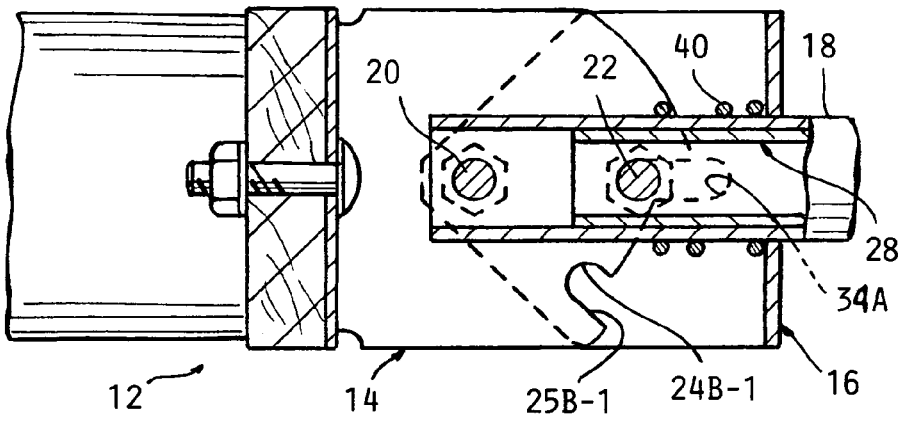
FIGS. 3A-3C are enlarged partially sectional views of the release and lock mechanism and fragmentary adjacent portions of the handle and broom head convertible of the broom shown in FIG. 1 in respective successive stages in converting the broom head from a straight broom to a push broom configuration.
Figure 3B:
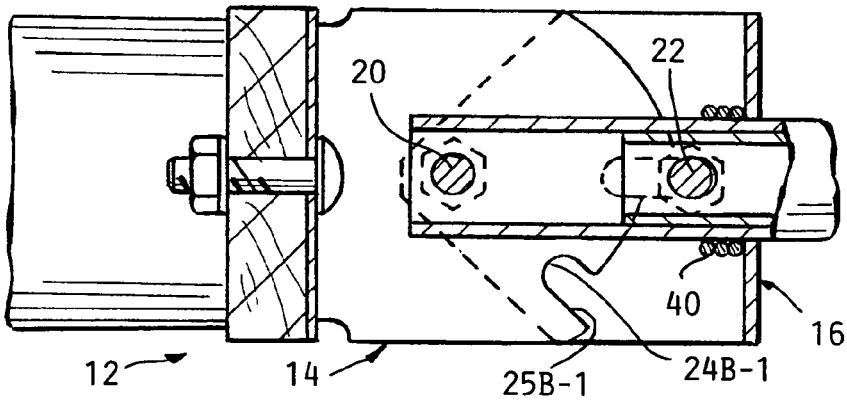
Figure 3C:
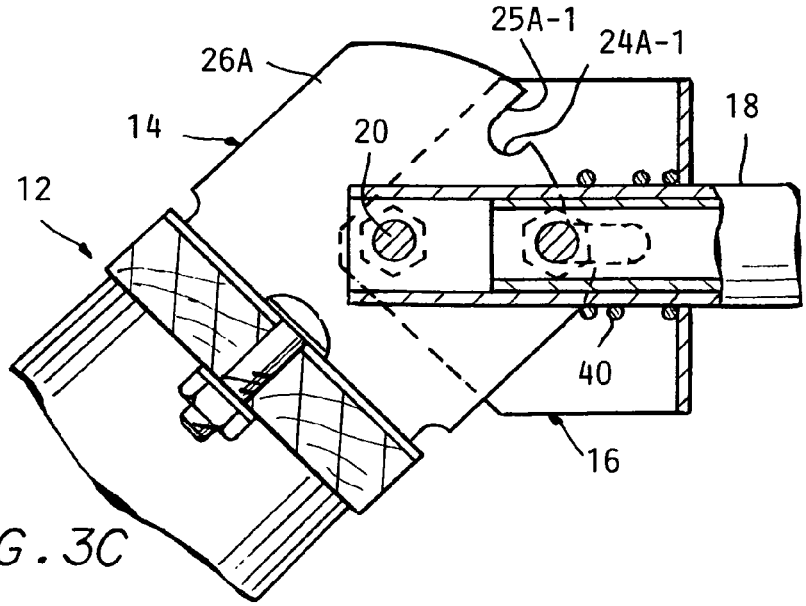
Figure 3D:
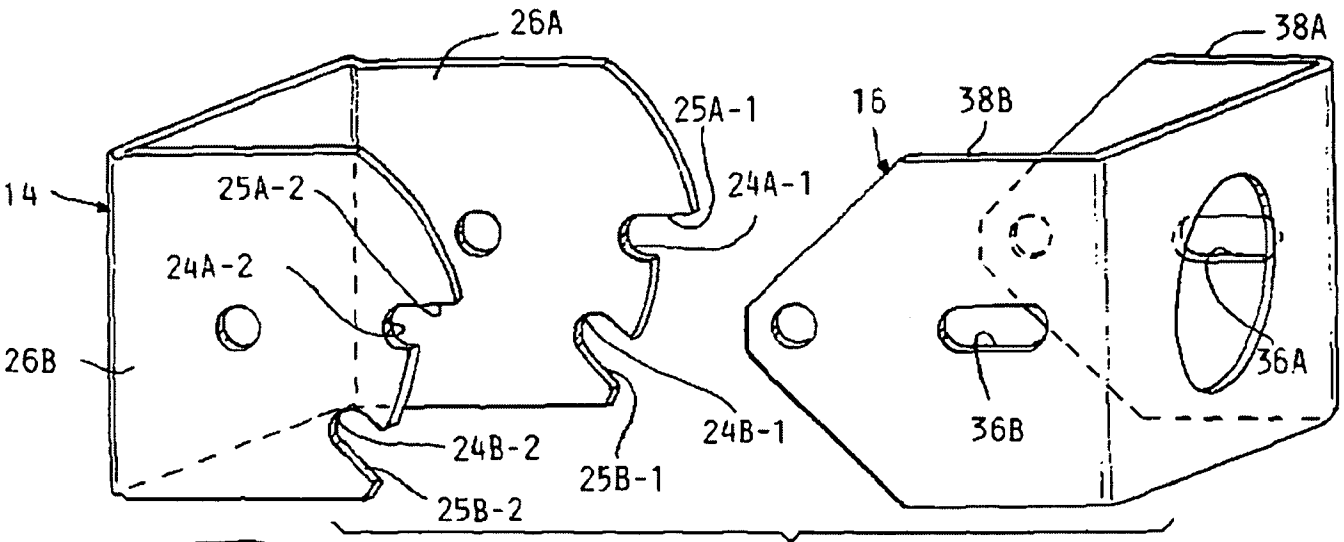
FIG. 3D is an exploded side pictorial of the head bracket and handle bracket shown in FIGS. 3A-3C.
Figure 7:
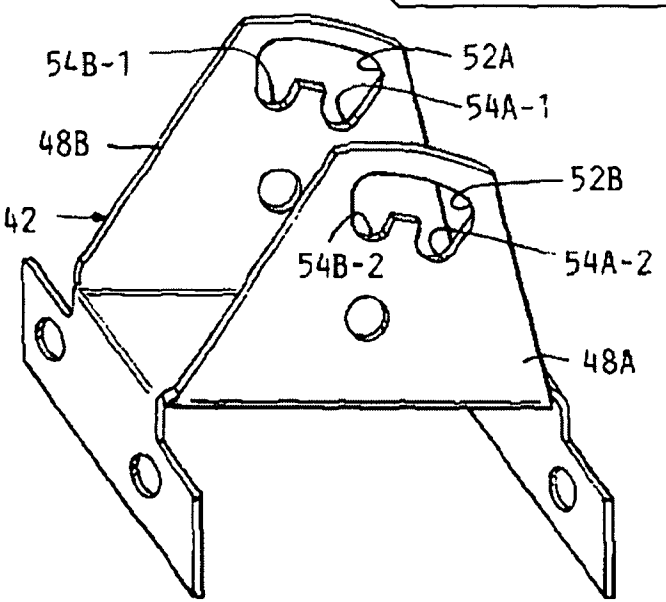
FIG. 7 is a pictorial view of the head bracket included in the embodiment shown in FIGS. 5A-5C and 6A and 6B.
Figure 4A:
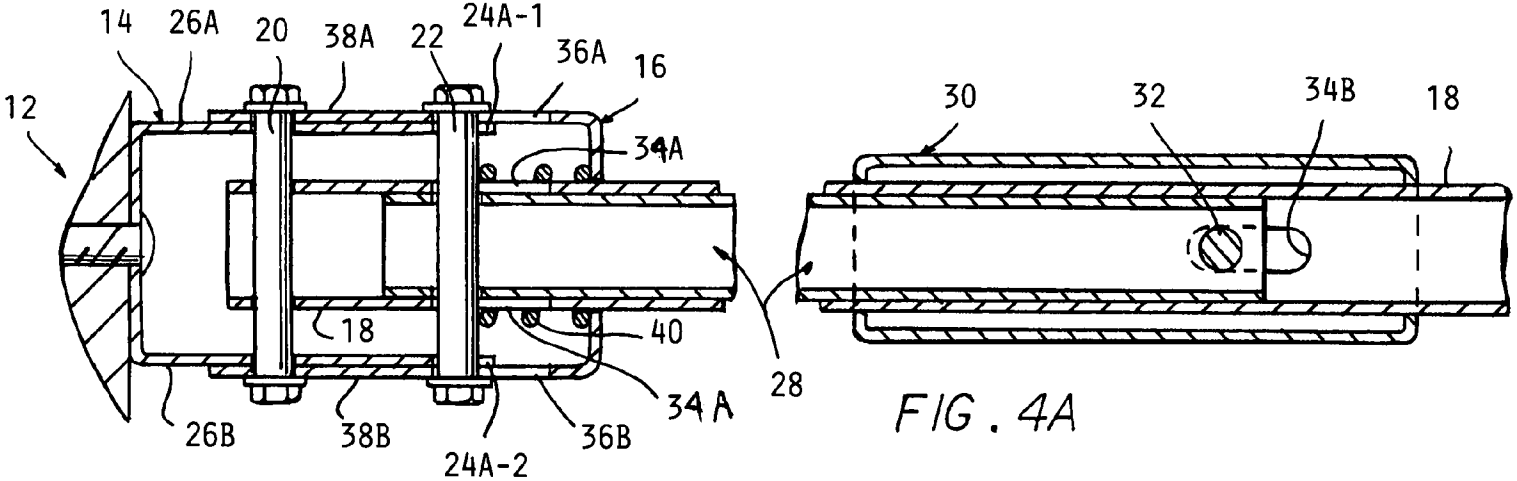
FIGS. 4A and 4B are views of longitudinal section 4-4 in FIG. 1 showing the rest and retracted position respectively of the operator grip and connected components.
Figure 4B:
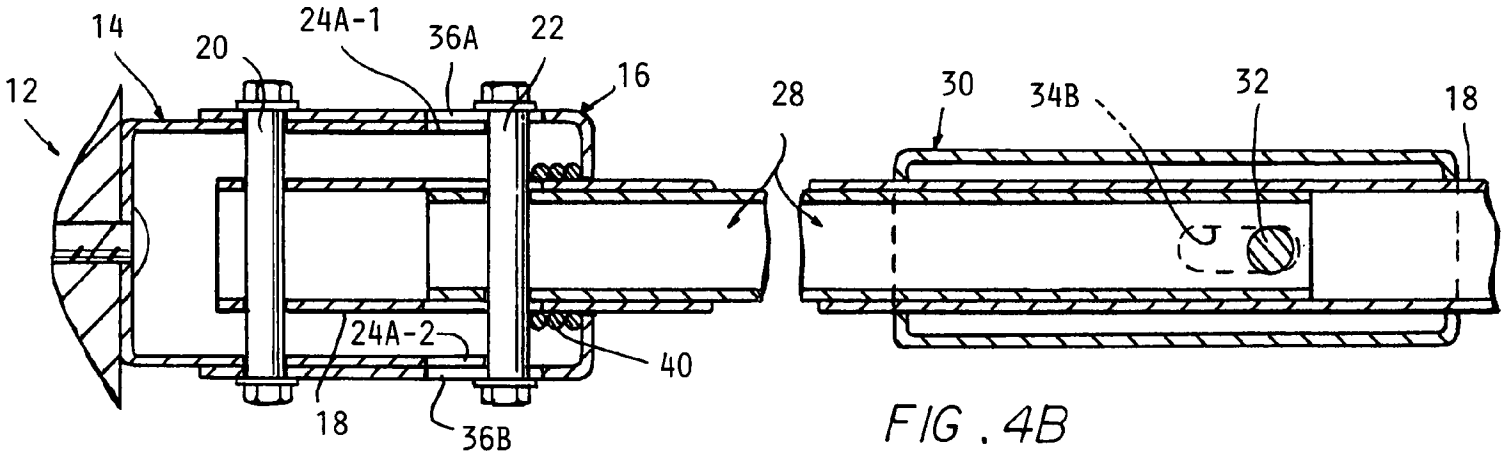
Figure 5C:
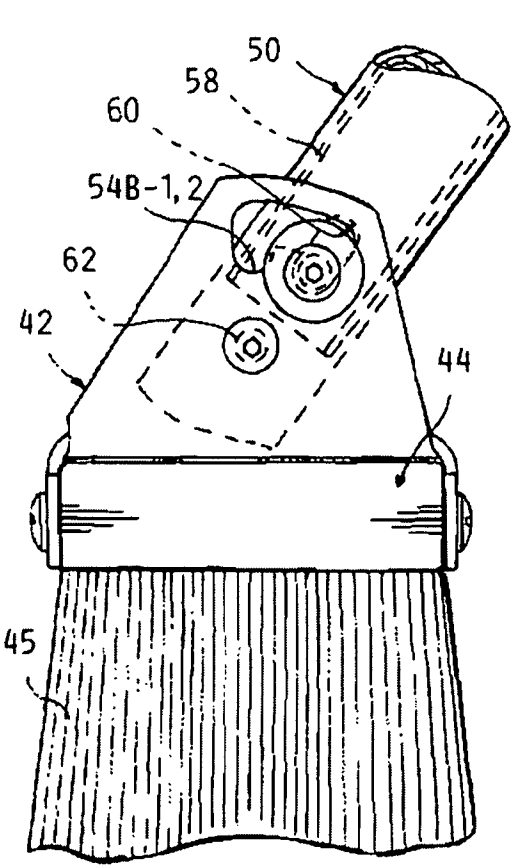
FIGS. 5A-5C are fragmentary front elevational views of a second embodiment of a convertible broom according to the invention with the pivot latch components in successive conditions during adjustment from a straight broom to a push broom configuration.
Figure 5B:
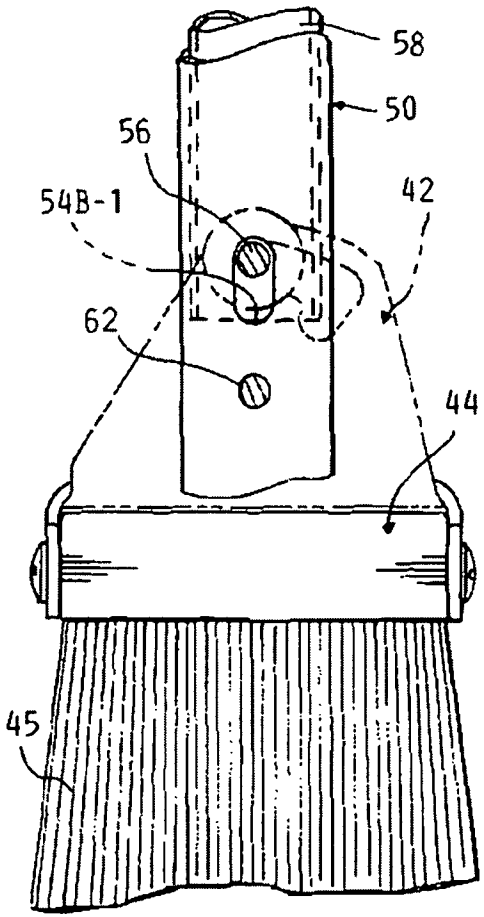
Figure 5A:
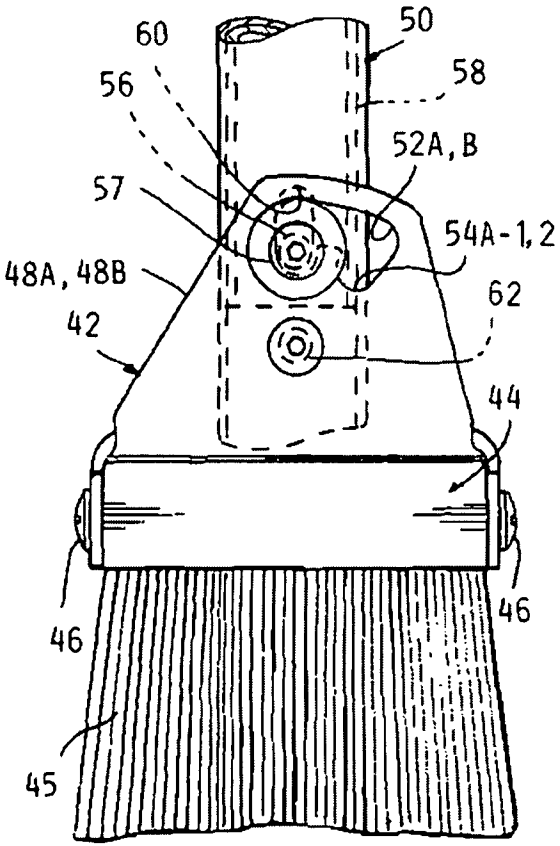
Figure 6A:
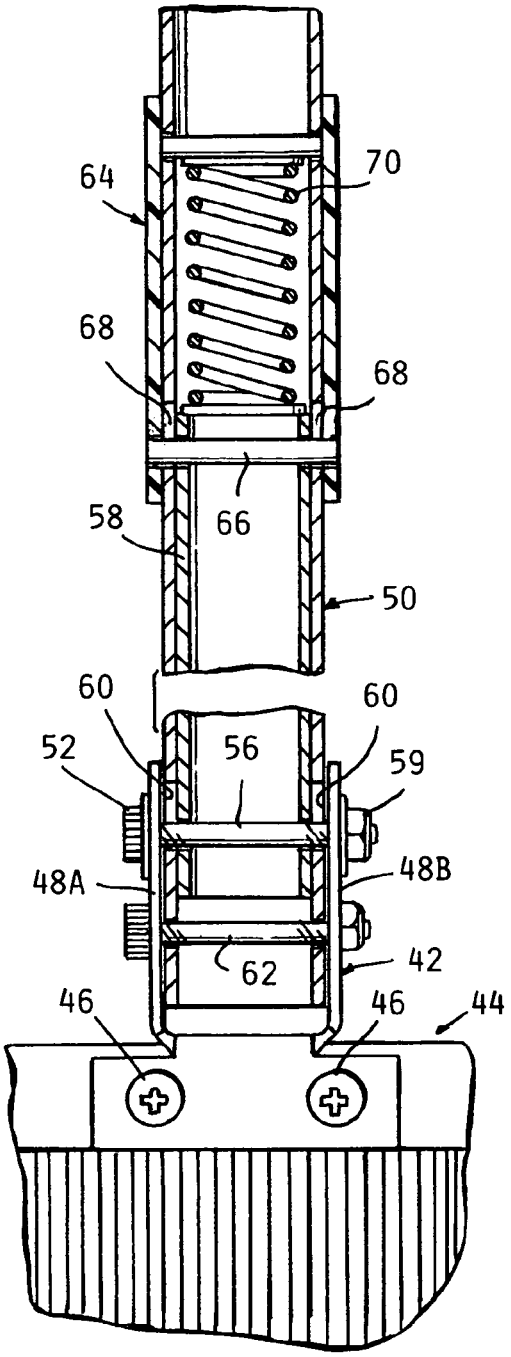
FIGS. 6A-6B are side elevational fragmentary view of portions of the convertible broom shown in FIGS. 5A-5C showing locked and unlocked positions of the pivot latch components.
Figure 6B:
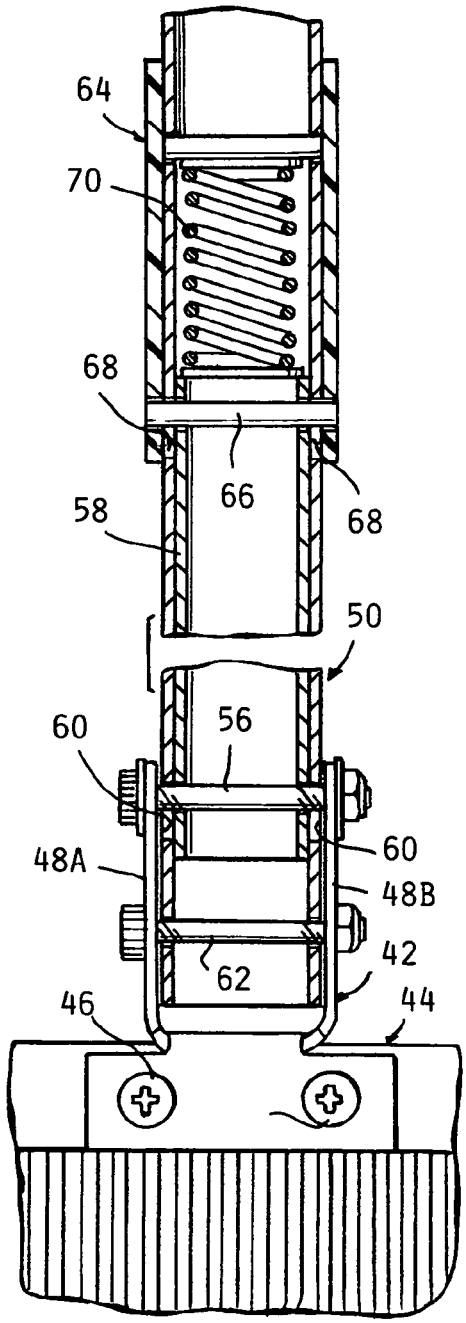

To restore the broom head 12 to the straight broom configuration, the broom 10 is again held in a generally horizontal position but rotated to be inverted as shown in FIG. 2C and the sleeve grip 30 pulled back.

When the broom head 12 is released by retraction of the movable locking cross bolt 22 out of notches 24B-1, 24B-2 it will pivot back by gravity to the straight broom sweep position where it is locked by the locking cross bolt 22 moving into notches 24A-1, 24A-2 upon release of the sleeve grip 30.

The movable locking cross bolt 22 catches on the projecting ledges 25A-1, 25A-2 when the head bracket 14 pivots back to the position aligned with the handle bracket 16. When the sleeve grip 30 is released, the movable locking cross bolt 22 is guided into the notches 24A-1, 24A-2 to again lock the broom head 12 in the straight orientation.

Referring to FIGS. 5A-5C, 6A, 6B, and 7 fragmentary portions of a second embodiment of a convertible broom according to the invention is shown which is somewhat simpler than the first described embodiment.

In this embodiment, only a head bracket 42 is provided attached to the broom head 44 having bristles 45 projecting therefrom, the broom head 44 attached to the head bracket 42 with screws 46.

The head bracket 42 has two sidewalls 48A, 48B between which is received the lower end of the broom handle 50.

An opening 52A, 52B is formed in each sidewall 48A, 48B, each opening aligned with the other, and each formed with a set of locator features comprised of sets of recesses or pockets 54A-1, 54A-2, 54B-1 and 54B-2.

A movable locking feature comprised of a locking cross pin or screw 56 is held in the end of an elongated operator member 58 slidable within the handle 50, the locking cross screw 56 having ends extending through each sidewall 48A, 48B through the openings 52A, 52B, and held therein by a cap 52 and nut 59 at either end.

A slot 60 in either side of the handle 50 also receives the locking cross screw 56 and accommodates the upward movement of the cross screw 56 when the member 58 is pulled up, as will be described.

A pivot element comprised of a fixed pivot cross screw 62 passes through a hole in the lower end of the handle 50 and each side wall 48A, 48B to pivotably mount the lower end of the handle 50 to the bracket 42 and thus to the broom head 44.

Operator member 58 extends up within the handle to an intermediate location where its upper end is attached to a sleeve grip 64 with a pin 66 passing through slots 68 in the handle 50.

A compression spring 70 urges the operator member 58 downward, so that the ends of locking cross screw 56 are also urged into engagement with either of two sets recesses 54A-1, 54B-1, or 54A-2 and 54B-2.

Upward pulling of the sleeve grip 64 withdraws the locking cross screw 56 out of one pair of recesses 54A-1, 54A-2 or 54B-1, 54B-2, to allow pivoting movement of the broom head 44 by gravity when held horizontally and to bring the cross screw 56 into alignment with the other pair of recesses 54A-1, 54A-2 or 54B-1, 54B-2 by abutment with one of the end walls on each side of openings 52A, 52B, which it then enters when the sleeve grip 64 is released, in similar fashion to the first described embodiment.

With the locking cross screw 56 in engagement with either of the sets of recesses, the handle 50 is locked in either corresponding pivoted position.

The endwalls of each opening 52A, 52B act to align the locking cross screw 56 with the sets of recesses 54A-1, 54B-1, or 54A-2, 54B-2 in each pivoted position of the head bracket 42 so that the user does not need to visually align the cross screw 56 therewith.

Thus a simple pivot latch mechanism have been described convenient to use even while using the broom sweeping to achieve the above recited object of the invention.

The invention claimed is:

1. A convertible broom comprising:

an elongated handle;

a broom head having bristles projecting therefrom;

a head bracket attached to said broom head;

a lower end of said handle having a pivotal connection to said head bracket allowing said head to swing relative said handle between a first pivoted position whereat said bristles project in the same general direction as a longitudinal axis of said handle and a second pivoted position whereat said bristles project in a generally transverse direction to said handle longitudinal axis;

a pivot latch mechanism selectively operable to lock said head bracket to said handle in either pivoted position, said pivot latch mechanism including two sets of one or more locator features formed on said head bracket and an elongated movable locking element held on an operator member slidably mounted to said handle so that said locking element is movable against a stop to assume a retracted position against said stop;

respective locator surfaces on said head bracket each able to be engaged by said retracted locking element upon movement from said retracted position to an advanced position in a respective first or second pivoted position of said head bracket by sliding movement of said operator member to locate said retracted locking element relative said head bracket in each of said first and second pivoted positions of said head bracket to be aligned thereby with said respective sets of one or more locator features on said head bracket in each of said first and second pivoted positions of said head bracket;

said movable locking element able to be moved by sliding motion of said operator member to said advanced position and thereby engage one or the other sets of said one or more locator features with said head bracket in said first or second positions; and said movable locking element also able to be moved by said operator member to be retracted to disengage said movable locking element with either of said sets of one or more locator features with said head bracket in a corresponding first or second pivoted position and reengaged with the other set of one or more locator features upon pivoting of said head to the other pivoted position, whereby said broom head may be moved by gravity from either said first or second pivoted position to the second or first pivoted position by holding said broom in a position to cause said head bracket to pivot by gravity to the other pivoted position after retraction of said operator member and disengagement of said locking element from said one of said sets of one or more locator features and locked in either said first or second position by movement of said operator member to said advanced position whereat said locking element engages the other of said sets of one or more locking features after pivoting of said head bracket to said other pivoted position.

2. The convertible broom according to claim 1 wherein said operator member is spring urged towards said advanced position to engage either of said sets of one or more locator features and manually movable against said spring urging to said retracted position.

3. The convertible broom according to claim 1 wherein said locator features comprise a pair of sets of one or more recesses formed into said head bracket and wherein said locking element is elongated and has a pair of opposite ends which are alternatively able to be inserted into engagement with a respective one of said sets of one or more recesses when said head bracket is in a respective first or second pivoted position.

4. The convertible broom according to claim 3 wherein said head bracket is U-shaped with two sides receiving said handle lower end therebetween, and wherein an opening is formed in each side of said head bracket with a pair of recesses formed into a perimeter of said openings in each of said two sides of said head bracket, and said locking element respective ends are alternatively aligned to be engageable with one or the other of said respective pairs of recesses after engaging surfaces defined by said opening when said operator member is in said retracted position as said head bracket moves to either of said first or second pivoted position.

5. The convertible broom according to claim 1 wherein said operator member comprises an elongated member slidable in a hollow in said handle, extending up to an intermediate point along said handle, sliding movement of said elongated member in opposite directions within said handle causes said elongated member to be in an advanced or retracted position to cause engaging or disengaging of said locking element with one of said one or more locator features in each set.

6. The convertible broom according to claim 5 wherein said elongated operated member has a sleeve grip slidable on the outside of said handle attached to an upper end of said elongated operator member, with an attachment of said sleeve grip to said operator member extending into said hollow within said handle, said handle slotted to accommodate movement of said attachment when said grip is slid on said handle.

7. The convertible broom according to claim 6 wherein said attachment comprises a pin extending crosswise through said upper end of said elongated member and openings in said handle, said openings comprising a slot on either of opposite sides of said handle.

8. The convertible broom according to claim 7 wherein a spring is mounted within said hollow in said handle engaging said upper end of said elongated member to urge said elongated member towards said one end of said handle to cause said locking element to be advanced into engagement with a respective one of said sets of one or more locator features.

9. The convertible broom according to claim 1 wherein said locking element is elongated and extends through said handle lower end at a point above said pivotal connection to said head bracket with opposite ends of said locking element respectively protruding through an opposite side of said handle, said handle having a slotted portion receiving said locking element to accommodate movement of said locking element with sliding movement of said operator member and to locate said locking element in a retracted position of said operator member by contacting an upper end of said slotted portion comprising said stop.

* * * * *